US006007591A

United States Patent [19]

Watanabe

[11] Patent Number: 6,007,591

[45] Date of Patent: Dec. 28, 1999

[54] ABRASIVE SHEET AND METHOD FOR PRODUCING SAME

[75] Inventor: Nobuyoshi Watanabe, Tokyo, Japan

[73] Assignee: Nihon Micro Coating Co., Ltd., Tokyo, Japan

[21] Appl. No.: 09/013,716

[22] Filed: Jan. 26, 1998

Related U.S. Application Data

[63] Continuation-in-part of application No. 08/605,373, Feb. 22, 1996, abandoned.

[30] Foreign Application Priority Data

Mar. 7, 1995 [JP] Japan ..... 7-72453

[51] Int. Cl.[6] ..... B24D 3/00; B24D 11/00; B24D 11/02

[52] U.S. Cl. ..... 51/297; 51/293; 51/295

[58] Field of Search ..... 51/293, 295, 297; 427/336; 428/143, 323, 333, 329, 335, 336, 148, 328, 334

[56] References Cited

U.S. PATENT DOCUMENTS

| | | | |
|---|---|---|---|
| 4,752,524 | 6/1988 | Yamaguchi et al. | 428/323 |
| 4,835,052 | 5/1989 | Yamamoto . | |
| 5,109,638 | 5/1992 | Kime, Jr. . | |
| 5,254,141 | 10/1993 | Yamazaki et al. . | |
| 5,355,636 | 10/1994 | Harmon . | |
| 5,401,560 | 3/1995 | Williams . | |
| 5,435,816 | 7/1995 | Spurgeon et al. . | |
| 5,573,444 | 11/1996 | Ryoke et al. | 451/28 |
| 5,611,826 | 3/1997 | Ryoke et al. | 51/295 |
| 5,632,789 | 5/1997 | Ryoke et al. | 51/295 |
| 5,633,068 | 5/1997 | Ryoke et al. | 51/295 |

*Primary Examiner*—Michael Marcheschi
*Attorney, Agent, or Firm*—Majestic, Parsons, Siebert & Hsue P.C.

[57] ABSTRACT

An abrasive sheet for precisely abrading a workpiece surface includes an adhesive and an abrading layer made by drying a slurry which is a mixture of abrasive particles and a binder. The abrading layer is preferably of thickness less than about 1.5 times the average size of the abrading particles and has one surface attached to a plastic base sheet through a layer of the adhesive. At least some of the abrading particles in the abrading layer have their end parts at the other surface of the abrading layer which, together with these end parts of the abrading particles, forms a smooth flat abrading surface without irregularly distributed protrusions and indentations.

10 Claims, 7 Drawing Sheets

ABRASIVE SHEET AND METHOD FOR PRODUCING SAME

This is a continuation-in-part of application Ser. No. 08/605,373 filed Feb. 22, 1996, now abandoned.

TECHNICAL FIELD

This invention relates to an abrasive sheet for abrading a magnetic hard disc, a lens, a magnetic head or the like, as well as a method for producing such an abrasive sheet. In particular, the invention relates to an abrasive sheet adapted for use for precise processing such as finish abrading and a method of producing an abrasive sheet of such a kind.

BACKGROUND OF THE INVENTION

Conventional abrasive sheets are produced by first forming a uniform and flat layer of a slurry, which may be a mixture of abrasive particles and a binder, on the surface of a plastic base film material by using a roller or a doctor blade and then drying this slurry to provide an abrading layer (as disclosed, for example, in Japanese Patent Publication No. 53-44714). On the surface of the slurry on such a prior art abrasive sheet, however, many protrusions and indentations are formed during the drying process of the slurry, although the slurry surface is once made flat and smooth by using a roller or a doctor blade prior to the drying process. Thus, such an abrading sheet could not be suitably used for a precise finishing process such as finish abrading because protruding parts of its uneven slurry surface would abrade a workpiece excessively.

The manner in which such undesirable unevenness is formed on the surface of the abrading layer is explained next with reference to FIGS. 6A and 6B. FIG. 6A is a sectional view of a prior art abrasive sheet when a plastic sheet (serving as its base sheet) 6 has just been coated with a slurry 3 comprising abrasive particles 1 and 1' and a binder 2 and its surface has been flattened, as explained above, by means of a roller or a doctor blade. As the slurry 3 is dried, however, the solvent is evaporated from the binder 2 and its heat of vaporization causes the temperature of the binder 2 to drop. If there is a relatively large abrasive particle (as indicated by 1' in FIGS. 6A and 6B) near the surface, evaporation of the solvent does not take place therearound and the temperature of the binder 2 does not drop significantly in its neighborhood. In other words, the temperature of the binder 2 becomes higher near large abrasive particles 1' than elsewhere, and this means that the solvent of the binder 2 evaporates more actively and hence dries up the slurry 3 more quickly near large abrasive particles 1'. As a result, the surface tension of the binder 2 becomes greater near large abrasive particles 1', causing the surface layer of the binder 2 to shift, as indicated by arrows 13 in FIG. 6B.

In regions where the concentration of the binder 2 is relatively high, the concentration of its solvent is also relatively high and hence there is more fluidity. Thus, those relatively large abrasive particles 1' are moved in the direction of the surface tension (or the arrows 13), dragging the slurry material therewith and forming protrusions 11 where they settle and indentations 12 between the protrusions 11, as shown in FIG. 6B.

There have been attempts to precisely control the average size of the abrasive particles in order to prevent the formation of such protrusions, but it was a difficult goal to attain. Even if the average particle size is controlled or the surface of the slurry layer is made flat before it is dried, the slurry surface becomes uneven after a drying process, resulting in an abrasive sheet with an uneven abrading surface having protrusions and indentations distributed in an irregular manner. If a workpiece is abraded by such an abrasive sheet, the protrusions on the abrading surface will cut deeply into its surface. In other words, a precise processing such as a finish abrading could not be carried out successfully with prior art abrasive sheets.

SUMMARY OF THE INVENTION

It is therefore an object of this invention to provide an abrasive sheet having a smoothly flattened abrading surface adapted for a precise abrading process, as well as a method of producing such an abrasive sheet.

It is a further object of this invention to provide such an abrasive sheet with which the amount of the abrading particles contained in its abrading layer can be economized, as well as a method of producing such an abrasive sheet.

An abrasive sheet of the present invention, with which the above and other objects can be accomplished, may be characterized as comprising a plastic base sheet, an abrading layer formed by drying a slurry which is a mixture of abrading particles and a binder, and an adhesive, one of the surfaces of the abrading layer adhering to the plastic base sheet through an adhesive layer formed by coating a surface of the plastic base sheet with the adhesive, end parts of at least a portion of the abrading particles in the abrading layer being positioned on the opposite surface of the abrading layer such that this opposite surface of the abrading layer and the end parts of these abrading particles form a flat abrading surface having no irregularly distributed protrusions or indentations. The thickness of the abrading layer may be less than about 1.5 times the average size of the abrading particles.

A method according to this invention for making such an abrading sheet may include the steps of applying a slurry, which is a mixture of abrading particles and a binder, on a surface of what will herein be referred to as a separable member, forming an abrading layer by drying the slurry thus applied on the surface of the separable member, forming an adhesive layer by applying an adhesive on a surface of a plastic base sheet, attaching the abrading layer to the plastic base sheet by superposing the surface of the plastic base sheet coated with the adhesive with the surface of the abrading layer, and removing the separable member from the abrading layer attached to the plastic base sheet such that the abrading surface of the abrading sheet will be of the shape of the surface of the separable member. In the above, the step of applying the slurry on the surface of the separable member may be carried out such that the thickness of the slurry layer is less than about 1.5 times the average size of the abrading particles. The step of attaching the abrading layer to the plastic base sheet may be carried out by overlapping the layer of the adhesive formed on the plastic base sheet with the abrading layer formed on the surface of the separable member and sandwiching them between a mutually opposite pair of pressure rollers to compress them together. In this method, the pressure between the axes of the pressure rollers may be between 1 kg weight/cm and 10 kg weight/cm. One of the mutually opposite pair of these roller may have protrusions formed on its surface such that the abrading layer can be attached to areas on the plastic base sheet corresponding to these protrusions. In this manner, it is possible to form at desired positions on the abrading sheet an abrading layer with thickness less than about 1.5 times of the average size of the abrading particles and having an abrading surface in the shape of the surface of the separable member.

In order to control the number of the abrading particles on the abrading surface of the abrading layer formed on the plastic base sheet (or the surface density of the abrading particles on the abrading layer), a slurry with viscosity in the range of 2 cp to 50 cp may be applied to the surface of the separable member. Alternatively, a slurry, of which the weight ratio between its binder and abrading particles is 1:6–12, may be applied to the surface of the separable member. The smaller the viscosity of the slurry or the weight ratio of its abrading particles with respect to its binder, the smaller will be the density of the abrading particles per unit surface area of the abrading layer.

In the production of abrasive sheets according to this invention, abrasive particles of diamond (C), alumina ($Al_2O_3$), iron oxide ($Fe_2O_3$), silicon carbide (SiC), chromium oxide ($Cr_2O_3$), cerium oxide ($CeO_2$), and their mixtures are used. The binder may be one made of nitrocellulose, acetyl cellulose, triethylcellulose, polyvinyl acetal, polyacrylic ester, polyvinyl alcohol, polyvinyl chloride, epoxy resin, polyisobutylene, natural rubber or their mixture.

An adhesive with thermal adhesive property may be used such as those comprising polyethylene resin, polypropylene resin, polyvinyl chloride resin, nylon and their mixtures. A plastic base sheet coated with such an adhesive to form an adhesive layer thereon is placed over the abrading layer formed as described above on the surface of a separable member, and the abrading layer is heated, while thus sandwiched between the plastic base sheet and the separable member, with pressure applied thereon by means of a heated roller or the like such that the abrasive layer is attached to the abrading layer.

Examples of an adhesive which can harden at a room temperature include polyester resin, polyurethane resin, polyacetate resin, polyvinyl chloride resin and their mixtures. The abrasive layer formed on the surface of a separable member as described above is placed on a plastic base sheet coated with such a resin and is then pressed by means of a roller or the like such that the abrasive layer adheres to the plastic base sheet at a normal temperature.

The plastic base sheet preferably comprises polyester, polypropylene, polyethylene or polyurethane. The separable member should be of a material which can be easily peeled off from the abrading layer formed on its surface and may comprise a sheet of a polytetrafluoroethylene polymer, a polypropylene sheet or a polyethylene sheet. At least the surface of the separable member on which the abrading layer is formed comprises a polytetrafluoroethylene polymer, glass or a metal with a mirror-polished surface.

When a slurry, which is a mixture of abrasive particles and a binder, is applied to a separable member and an abrasive layer is formed on the separable member after the slurry is dried, irregularly distributed unevenness results on the surface of the abrasive layer, but no such unevenness is formed on the opposite surface of the abrasive layer contacting the separable member. Instead, there results a surface of a shape conforming with the surface of the separable member.

The separable member is made of a material capable of being separated from the abrasive layer. A plastic base sheet coated with an adhesive is attached to the abrasive layer formed on the separable member. The plastic base sheet is then peeled off the separable member. As the plastic base sheet is thus separated, the abrasive layer attached to the plastic base sheet can be smoothly separated from the separable member. The uneven surface of the abrasive layer is attached to the plastic base sheet through an adhesive, and the surface which was initially covered by the separable member is exposed as the abrasive surface.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Throughout herein, like components are indicated by like numerals/symbols and may not necessarily be described in detail repetitiously.

DETAILED DESCRIPTION OF THE INVENTION

Figure 1:
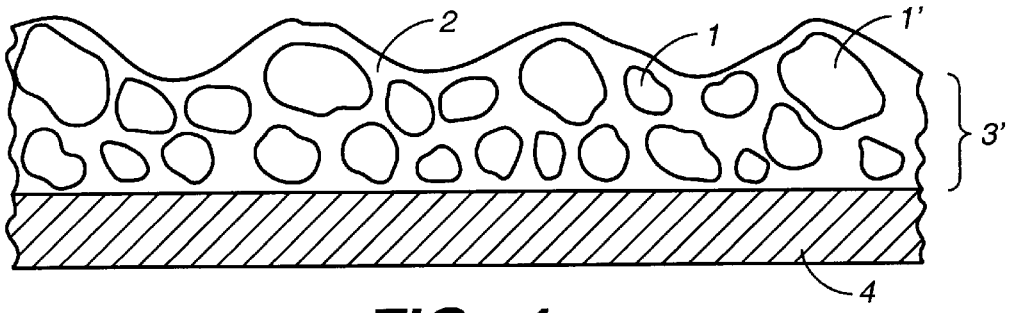
FIGS. 1, 2 and 3 are sectional views of a portion of an abrasive sheet at different stages of its production by a method according to this invention.

An abrading sheet embodying this invention, as well as a method of its production, will be described next with reference to FIGS. 1–3.

Figure 6A:
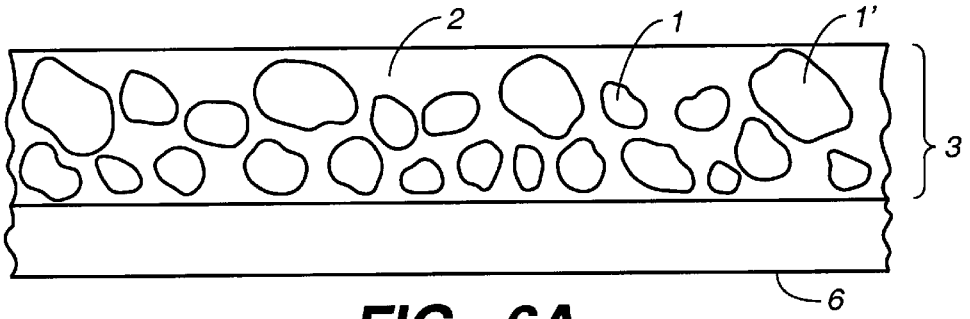
FIG. 6A (PRIOR ART)
FIG. 6A is a sectional view of a portion of a prior art abrasive sheet during its production before the slurry is dried.
Figure 6B:
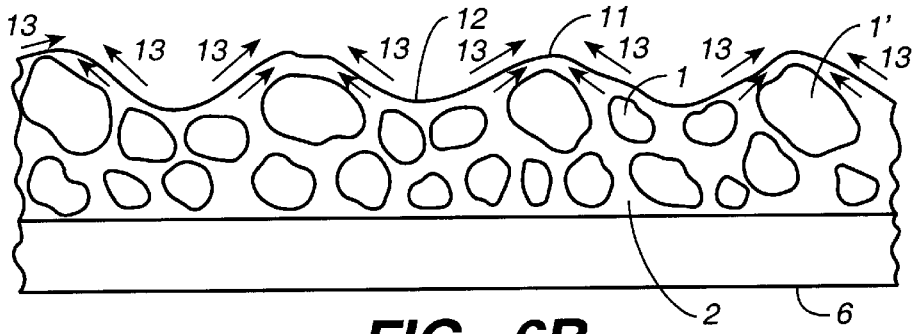
FIG. 6B (PRIOR ART)
FIG. 6B is a sectional view of a portion of the prior art abrasive sheet of FIG. 6A while the slurry is being dried.

As a first step, a roller or a doctor blade (not shown) is used to coat a surface 4' of a separable member 4 with a slurry 3 made by mixing abrading particles 1, 1' and a binder 2. The slurry 3 is then dried by means of a dryer (not shown) such that an abrading layer 3' is formed as shown in FIG. 1. It is to be noted that the top surface of this abrading layer 3' is uneven, as explained above with reference to FIG. 6B, but its bottom surface, contacting the separable member 4, remains smooth in the same form as the surface 4' of the separable member 4 on which the slurry 3 was first applied.

Figure 2:
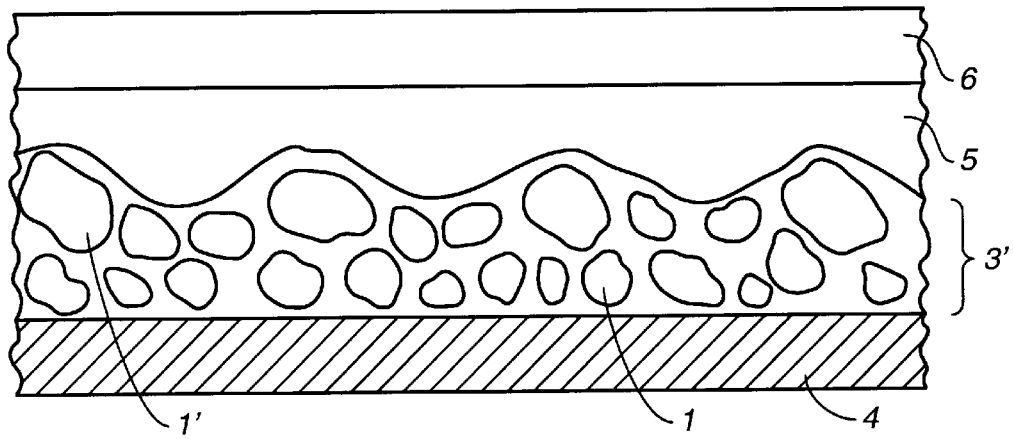
Figure 3:
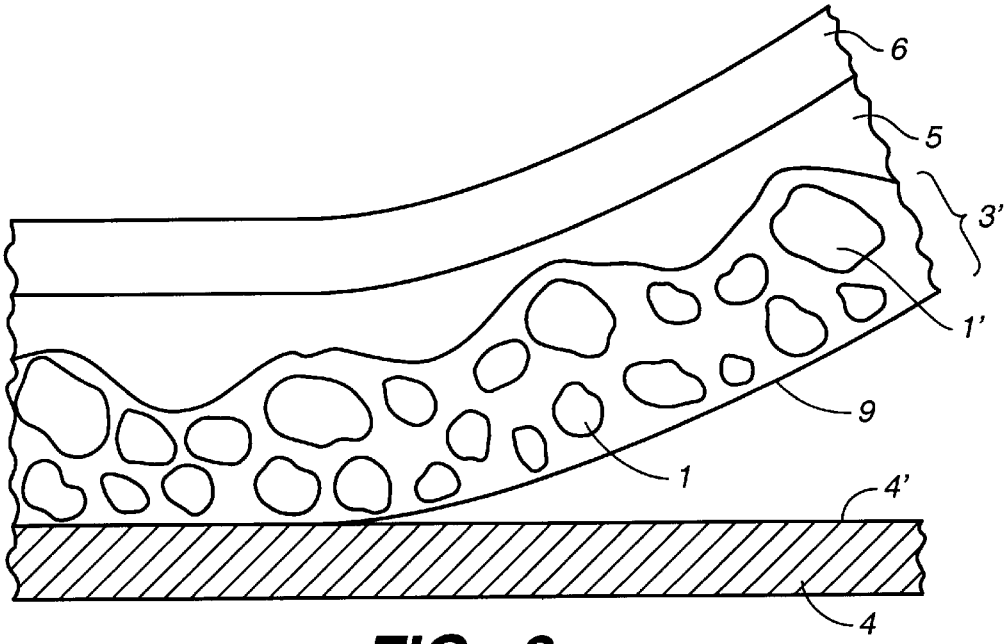

Next, an adhesive 5 is applied to a surface of a plastic base sheet 6 to thereby form an adhesive layer, and this plastic base sheet 6 is placed overlappingly over and attached to the aforementioned uneven surface of the abrading layer 3', as shown in FIG. 2. Thereafter, as shown in FIG. 3, both the plastic base sheet 6 and the abrading layer 3' are together peeled off the plastic base sheet 6. Since the separable member 4 is made of a material which can be easily peeled off the abrading layer 3' such as a commercially available kind of polytetrafluoroethylene polymer, the abrading layer 3' can be peeled off the separable member 4 without adversely affecting the smooth surface quality of its abrading surface 9 which was in contact therewith and the surface of the abrading layer 3' after the peeling off is of the same form as the surface 4' of the separable member 4.

Figure 4:
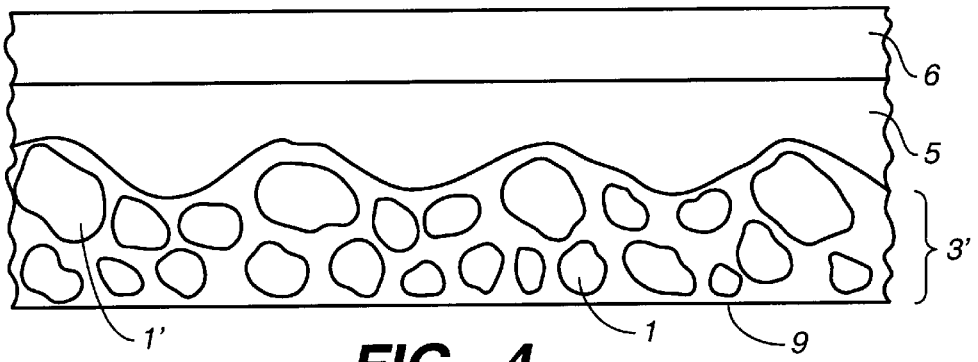
FIG. 4 is a sectional view of a portion of an abrasive sheet embodying this invention produced by a method illustrated by FIGS. 1–3.

The abrading sheet, thus produced as explained above, comprises, as shown in FIG. 4, an abrading layer 3' obtained by drying a slurry 3 which is a mixture of abrading particles 1, 1' and a binder 2 and attached to a plastic base sheet 6 by means of an adhesive 5, having an abrading surface 9 which is the surface of the abrading layer 3' originally in contact with the surface 4' of the separable member 4. Thus, the abrading surface 9 is as smooth and flat as the surface 4' of the separable member 4 from which the abrading layer 3' was separated.

Figure 5:
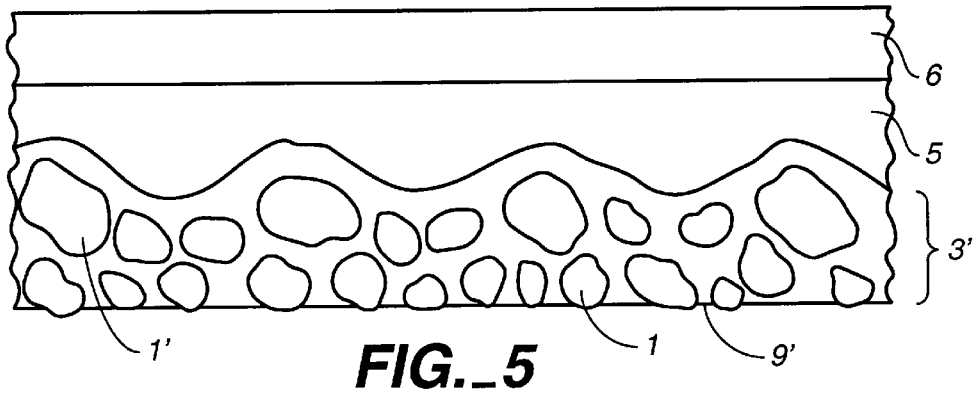
FIG. 5 is a sectional view of a portion of another abrasive sheet embodying this invention.

If the abrading particles 1, 1' on the abrading surface 9 are substantially entirely covered by the binder 2, a solvent mixture of methylketone and acetone may be sprayed on this surface 9 with compressed air or may be applied by using a felt brush (as disclosed in U.S. Pat. No. 4,835,052) to remove a portion of the binder 2, covering the abrading particles 1, 1', thereby forming a new abrading surface 9' as shown in FIG. 5 with some abrasive particles 1, 1' exposed externally.

It is to be noted that it is only those of the abrading particles 1, 1' exposed externally on the abrading surface 9' that contribute substantially to the abrasion of a workpiece when the abrading sheet is actually in use. In other words, those of the abrading particles 1, 1' not exposed externally on the abrading surface 9' are useless, and it is desired to reduce such a waste, or to reduce the number of abrading particles 1, 1' which do not contribute to the abrasion. According to a preferred embodiment of this invention, therefore, the thickness of the abrading layer formed on the surface of a plastic base sheet is reduced to less than about 1.5 times the average diameter of the abrading particles 1, 1'. An abrading layer with such a reduced thickness is herein referred to as "a thin abrading layer" and can be formed as described above with reference to FIGS. 1–4 except that a roller or a doctor blade is used (not shown) such that the slurry 3 is applied to the surface 4' of the separable member 4 to a thickness less than about 1.5 times the average diameter of the abrading particles 1, 1'.

Explained more in detail, an abrasive sheet embodying this invention characterized as having such a thin abrading layer can be produced by coating a surface of a separable member with a slurry which is a mixture of abrading particles and a binder such that its thickness will be less than about 1.5 times the average diameter of the abrading particles and then drying the slurry thus applied so as to form an abrading layer of thickness less than about 1.5 times the average diameter of the abrading particles on the surface of the separable member. An adhesive is applied to a surface of a plastic base sheet to form an adhesive layer on the surface of the plastic base sheet, and after this plastic base sheet is overlappingly placed over the abrading layer, they are pressed together between a pair of mutually opposite pressure rollers such that at least a portion, or portions, of the thin abrading layer will become adhered to the plastic base sheet. The separable member in this case may be of the same material as described above with reference to FIGS. 1–4. The pressure of compression by these rollers is between 1 kg weight/cm and 10 kg weight/cm (between their axes).

One of the pair of mutually opposite pressure rollers may have protrusions formed according to a design such as comprising circles, diagonal lines, curving lines and their combinations such that only the parts of the thin abrading layer corresponding to such a design will come to adhere to the surface of the plastic base sheet. Thereafter, the separable member is peeled at least off a portion, or portions, of the thin abrading layer attached to the plastic base sheet.

The number of abrading particles per unit surface area of the thin abrading layer (or the areal density) can be controlled if the viscosity of the slurry is between 2 cp and 50 cp. The higher the viscosity of the slurry, the higher can the density of the abrading particles be made per unit surface area of the thin abrading layer. The areal density of the abrading particles can be also controlled by adjusting the weight ratio between the binder and the abrading particles in the slurry to be within the range of 1:6–12. The larger this ratio, the higher can be made the density of the abrading particles per unit surface area of the thin abrading layer.

Figure 7:
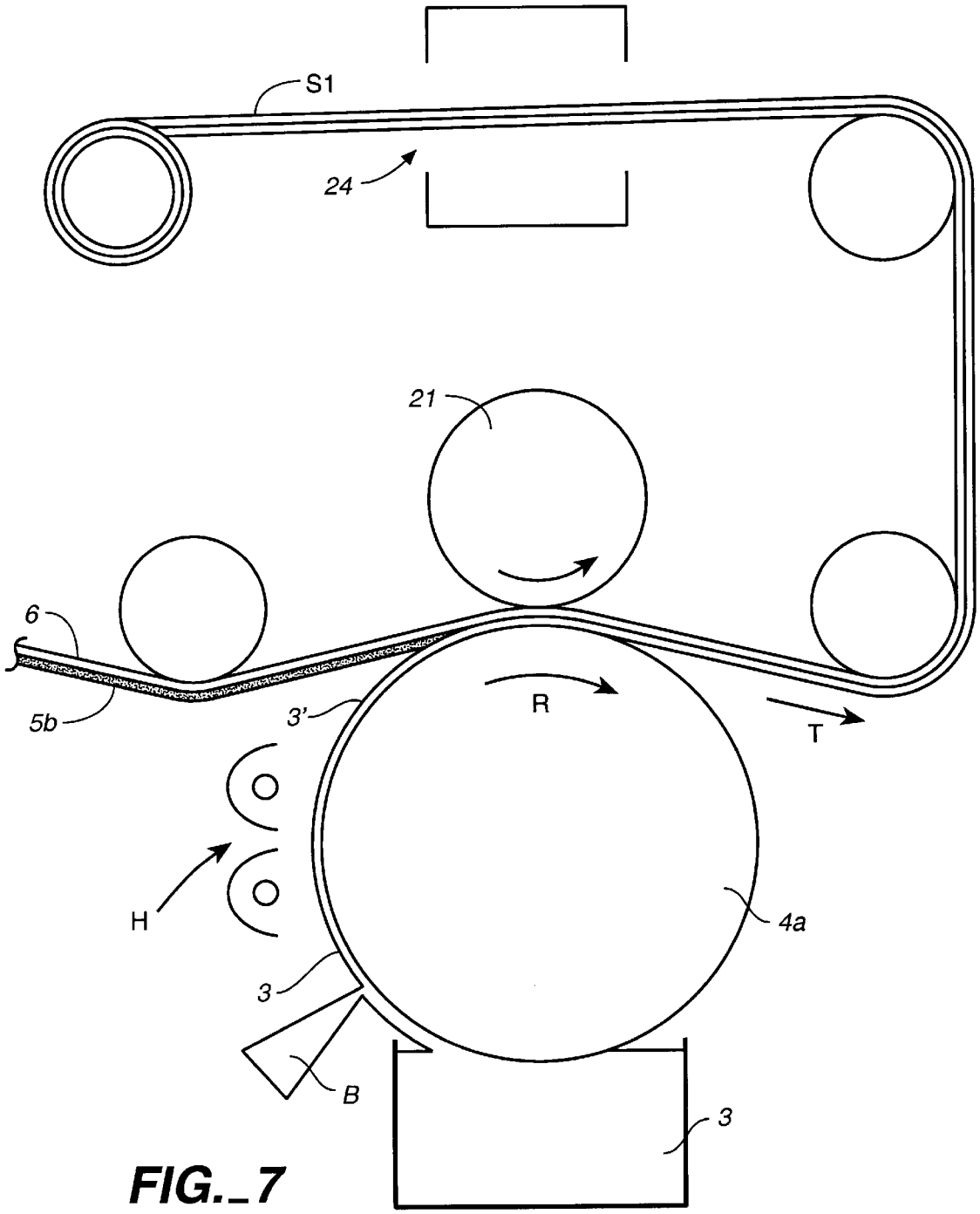
FIG. 7 is a schematic diagram of an apparatus for producing an abrasive sheet embodying this invention

FIG. 7 shows an apparatus for producing an abrasive sheet embodying this invention (indicated by symbol S1). A slurry 3 is applied on a cylindrically shaped separable member 4*a* made of Teflon (tradename) which rotates in the direction shown by arrow R. After the outer surface of the slurry 3 is smoothed by means of a blade B, the slurry 3 is dried by means of an infrared heater H to form an abrasive layer 3' on the cylindrical surface of the separable member 4*a*. A polyester sheet 6 of thickness about 20 $\mu$m, coated with a thermo-adhesive resin 5*b* is pressed onto the abrasive layer 3' on the cylindrical surface of the separable member 4*a* by means of a heat roller 21. After this polyester sheet 6 is attached to the abrading layer 3' by the heat of this heat roller 21, the polyester sheet 6 is caused to travel in a direction (indicated by arrow T) away from the separable member 4*a* such that the abrading layer 3' attached to the polyester sheet 6 is peeled off the surface of the separable member 4*a*.

In the example being described above, use is made of abrading particles of alumina with average diameter 3 $\mu$m and a binder comprising nitrocellulose. The slurry 3 is produced by mixing such abrading particles and the binder together at a weight ratio of 0.5–10.0 to 1. The mixture is stirred uniformly by a dispersing machine. The slurry has viscosity of 80–500 cp. The distance between the blade B and the separable member 4*a* is adjusted such that the thickness of the abrading layer 3' would be 10 $\mu$m. Thermo-adhesive polyethylene resin is used as the thermo-adhesive resin 5*b* and is applied uniformly to the surface of the polyester sheet 6 by a prior art method of application using a blade or a roller. The heat roller 21 is heated to a temperature in the range of 100–150° C.

The polyester sheet 6 coated with this adhesive 5*b* is placed over the abrading layer 3' and is heated and pressed by the heat roller 21 such that the adhesive 5*b* is hardened and the polyester sheet 6 becomes adhered to the abrading layer 3'. In this process, the thermo-adhesive resin 5*a* is first hardened only to the extent such that the abrading layer 3' can be peeled off the separable member 4*a* . After the abrading sheet 3' is separated from the separable member 4*a* while remaining attached to the polyester sheet 6, the thermo-adhesive resin 5*b* is hardened more firmly by means of a drying means 24.

The polyester sheet 6 (serving as an example of plastic base sheet according to this invention) is more resistant against heat than the thermo-adhesive polyethylene resin but since it becomes soft and deformed if kept at a high temperature for an extended period of time, the temperature of the heat roller 21 and the duration of time for compressing the plastic base sheet 6 must be adjusted appropriately such that deformation of the plastic base sheet 6 can be prevented. The separable member 4*a* comprising Teflon has sufficient resistance against heat.

Figure 8:
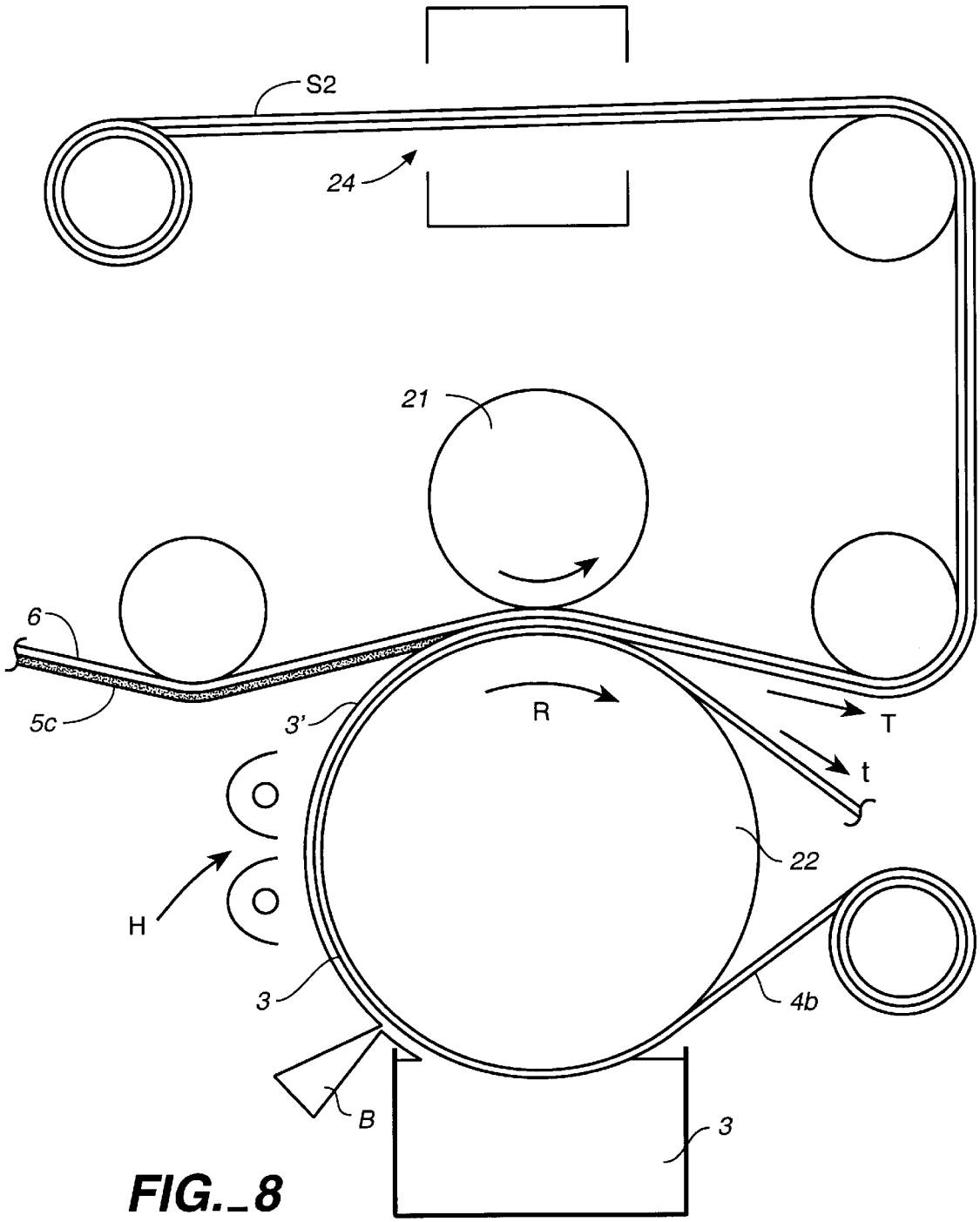
FIG. 8 is a schematic diagram of another apparatus for producing an abrasive sheet embodying this invention.

FIG. 8 shows another apparatus for producing an abrasive sheet embodying this invention (indicated by symbol S2) comprising a polypropylene sheet 4*b* (serving as "the separable member") with thickness 16 μm which is easily separable from a binder. This polypropylene sheet 4*b* is passed partially around a roller 22 and caused to travel in the direction of rotation of the roller 22 (indicated by arrow R) while a slurry 3 is applied on its surface and its surface is smoothed by a blade B. The slurry 3 is then dried by means of an infrared heater H to form an abrading layer 3' on the surface of the polypropylene sheet 4*b* rotating with the roller 22.

A polyester sheet 6 of thickness 16 μm, coated with an adhesive 5*c*, is pressed onto the abrading layer 3' on the polypropylene sheet 4*b* by means of a heat roller 21 such that the polyester sheet 6 becomes adhered to the abrading layer 3'. Next, the polyester sheet 6 is caused to travel in the direction indicated by arrow T in FIG. 8 so as to move away from the polypropylene sheet 4*b* which is caused to travel in another direction indicated by arrow t such that the abrading sheet 3' attached to the polyester sheet 6 is separated from the surface of the polypropylene sheet 4*b*. Thereafter, the abrading sheet 3' is dried further by a drying means 24 in order to more securely attach it to the polyester sheet 6.

The abrading particles comprise alumina with average diameter 1 μm. The binder comprises nitrocellulose and a mixed solvent of methylketone and acetone in which 5 weight % (with respect to the nitrocellulose) of epoxy resin is stirred. The slurry 3 is made by mixing 1–10 weight parts of abrading particles with 1 weight part of the binder and uniformly stirring them together by means of a dispersing machine. The viscosity of the slurry 3 is within the range of 80–500 cp.

The distance between the blade B and the separable member 4*b* is adjusted such that the thickness of the abrading layer 3' will be 5 μm. The adhesive 5*c* comprises polyester resin and is uniformly applied on the surface of the polyester sheet 6 by a conventional means having a roller or a blade (not shown) and is dried at normal temperature such that its adhesive characteristic will not be lost. The heat roller 21 is heated to 60–80° C.

As this polyester sheet 6 coated with the adhesive 5*c* is pressed against the abrading layer 3' while being heated by the heat roller 21, the adhesive 5*c* is hardened and the polyester sheet 6 becomes adhered to the abrading layer 3'. This process is carried out by first hardening the thermo-adhesive resin only to such an extent that the abrading layer 3' can be separated from the separable member 4*b*, and then hardening the thermo-adhesive resin further by a drying means 24 after the abrading layer 3' is separated from the separable member 4*b* while remaining attached to the polyester sheet 6.

For making comparisons with aforementioned abrasive sheets S1 and S2 described above with reference to FIGS. 7 and 8, prior art abrasive sheets S1' and S2' were prepared by repeatedly sorting the abrading particles such that their sizes would be uniform.

Prior art abrasive sheet S1' was for comparison with abrasive sheet S1 embodying this invention. A slurry with viscosity 80–500 cp was prepared by using a dispersing machine to stir and to uniformly mix together a binder comprising nitrocellulose and abrading particles with average diameter 3 μm. This slurry was applied to a polyester base sheet of thickness 20 μm such that the thickness of the slurry would be 10 μm, and it was then dried to obtain prior art abrasive sheet S1'.

Prior art abrasive sheet S2' was for comparison with abrasive sheet S2 embodying this invention. Another slurry with viscosity 80–500 cp was prepared by using a dispersing machine to stir and to uniformly mix together the same binder described above that was used for the preparation of aforementioned abrasive sheet S2 and abrading particles of alumina with average diameter 1 μm at weight ratio of 1:10. This slurry was applied to a polyester base sheet of thickness 16 μm such that the thickness of the slurry would be 5 μm, and it was then dried to obtain prior art abrasive sheet S2'.

Abrasive sheets S1, S2, S1' and S2' were used to abrade surfaces of magnetic hard discs and the protrusions and indentations formed on the abraded surfaces were examined. The maximum height difference between the protrusion and the indentation when an abrasive sheet of the present invention (S1 or S2) was used was less than a half of that when a prior art abrasive sheet (S1' or S2') was used.

Figure 9A:
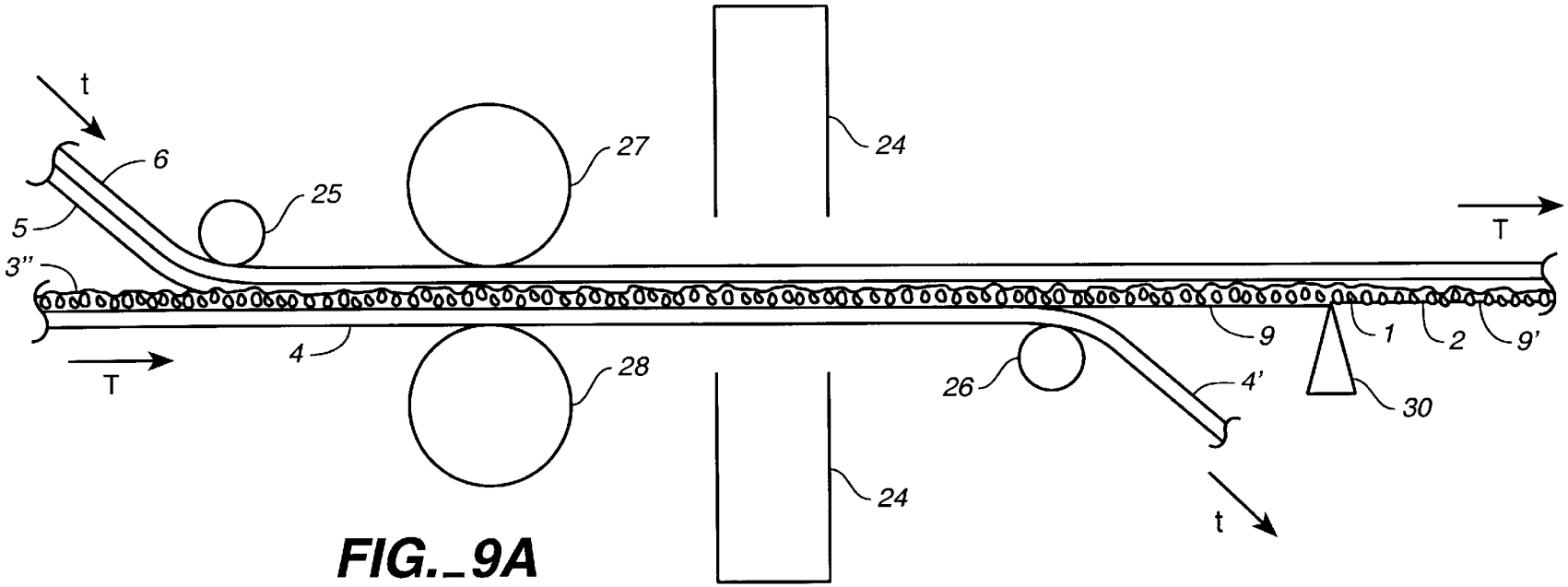
FIG. 9A is a schematic diagram of still another apparatus for producing an abrasive sheet embodying this invention, FIG. 9B showing a portion of FIG. 9A enlarged.
Figure 9B:
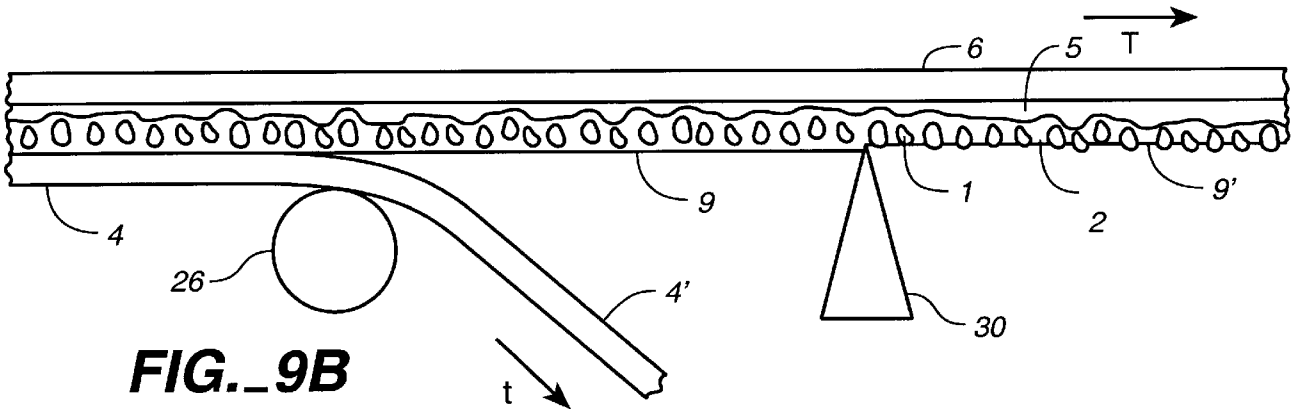

FIGS. 9A and 9B show still another apparatus for producing an abrasive sheet embodying this invention. A slurry with viscosity 10 cp, which is a mixture of abrading particles 1 of alumina with average diameter 3 μm and a binder 2 comprising nitrocellulose at weight ratio of 1:9, is applied to the surface 4' of a polypropylene sheet 4 of thickness 20 μm serving as a separable member such that the thickness of the slurry is about 4 μm and is dried to form a thin abrading layer 3" with thickness about 4 μm on the surface 4' of the polypropylene sheet 4. An adhesive 5, comprising a polyester resin which can harden suitably at normal temperature, is applied to the surface of a polyester sheet 6 with thickness 20 μm serving as the plastic base sheet according to this invention.

The polyester sheet 6 with a layer of the adhesive 5 formed thereon is caused to travel in the direction of arrow T while the polypropylene sheet 4 with the thin abrading layer 3" formed thereon is caused to travel in the direction of arrow t and is guided by a small roller 25 such that the layer of the adhesive 5 on the polyester sheet 6 is positioned overlappingly over the surface of the thin abrading layer 3" on the surface 4' of the polypropylene sheet 4. Thereafter, the layer of the adhesive 5 and the thin abrading layer 3" are pressed together in a face-to-face relationship, sandwiched between a pair of mutually opposite pressure rollers 27 and 28 at a pressure of 10 kg weight/cm (between their axes) such that the thin abrading layer 3" becomes adhered to the polyester sheet 6.

Next, while the thin abrading layer 3" and the layer of the adhesive 5 are sandwiched between the polyester sheet 6 and the polypropylene sheet 4, they are passed inside a dryer 24 such that the adhesive 5 is hardened. Thereafter, the polypropylene sheet 4 is peeled off by means of a small roller 26 from the thin abrading layer 3" which is now firmly attached to the polyester sheet 6 such that an abrading surface 9 having the same shape as the surface 4' of the polypropylene sheet 4 is formed on the thin abrading layer 3" .

Finally, a brush 30 is used together with an organic solvent to scrape off the binder 2 covering the alumina particles 1 contained in the thin abrading layer 3", as more clearly shown in FIG. 9B, such that a particle-exposing abrading surface 9' will result, exposing ends of the abrading particles 1 of the thin abrading layer 3". The average density of abrading particles in this abrading surface 9' is 6 per unit area of 10 μm×10μm.

Figure 10A:
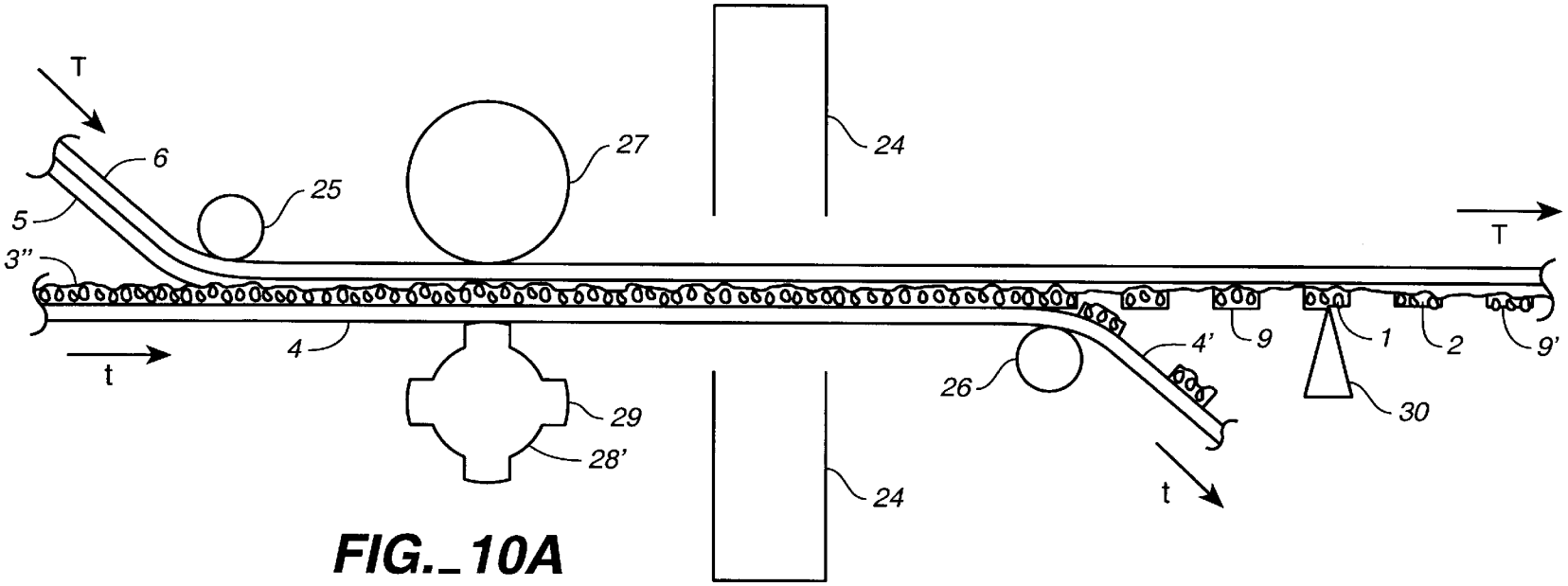
FIG. 10A is a schematic diagram of still another apparatus for producing an abrasive sheet embodying this invention, FIG. 10B showing a portion of FIG. 10A enlarged.
Figure 10B:
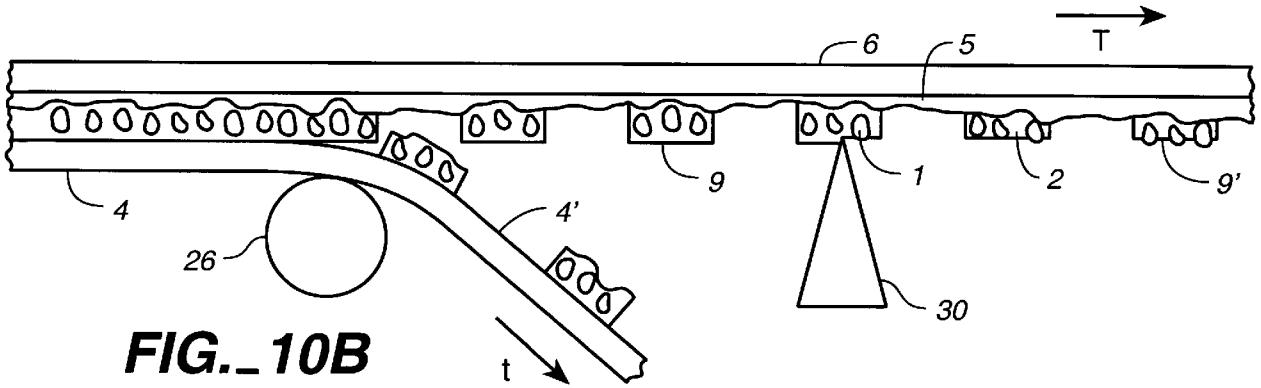
Figure 11A:
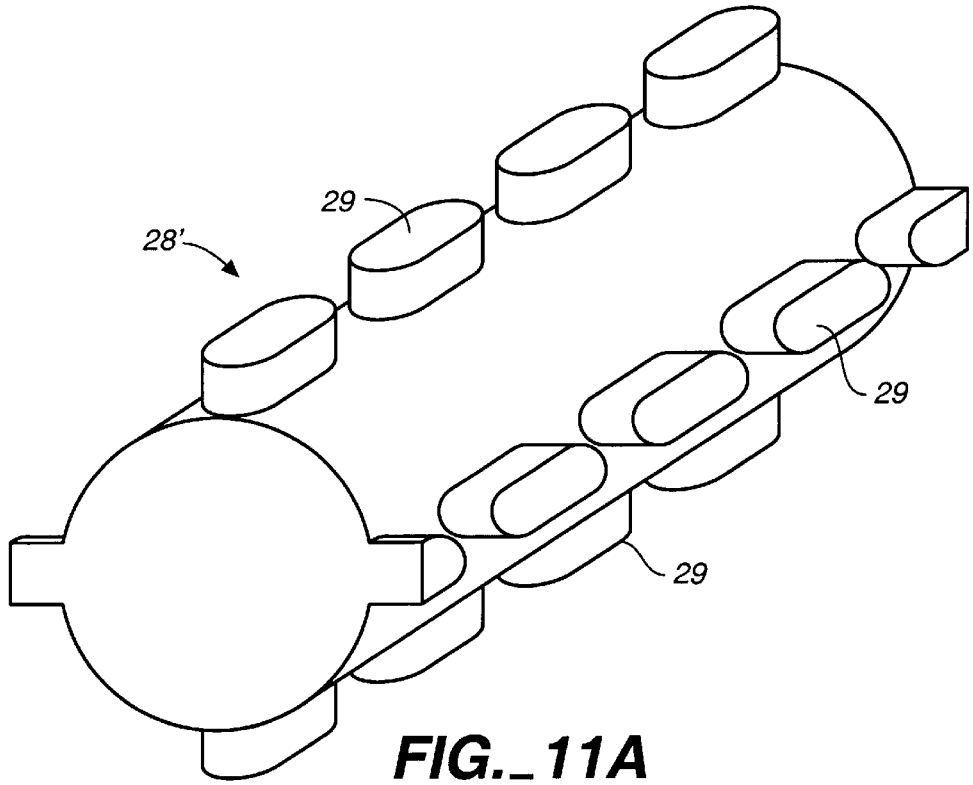
FIG. 11A is a diagonal view of a compression roller used for the production of an abrasive sheet embodying this invention.

FIGS. 10A and 10B show still another apparatus for producing an abrasive sheet embodying this invention. A slurry with viscosity 10 cp, which is a mixture of abrading particles 1 of alumina with average diameter 3 μm and a binder 2 comprising nitrocellulose at weight ratio of 1:10, is applied to the surface 4' of a polypropylene sheet 4 of thickness 20 μm serving as a separable member such that the thickness of the slurry is about 4 μm and a thin abrading layer 3" with thickness about 4 $\mu$m is formed on the surface 4' of the polypropylene sheet 4. Next, as explained above with reference to FIGS. 9A and 9B, the polyester sheet 6 with a layer of the adhesive 5 formed thereon is caused to travel in the direction of arrow T while the polypropylene sheet 4 with the thin abrading layer 3" formed thereon is caused to travel in the direction of arrow t and is guided by a small roller 25 such that the layer of the adhesive 5 on the polyester sheet 6 is positioned overlappingly over the surface of the thin abrading layer 3" on the surface 4' of the polypropylene sheet 4. Thereafter, the layer of the adhesive 5 and the thin abrading layer 3" are pressed together in a face-to-face relationship, sandwiched between a pair of mutually opposite pressure rollers 27 and 28' at a pressure of 10 kg weight/cm (between their axes) such that the thin abrading layer 3" becomes adhered to the polyester sheet 6. The lower one of the pair of pressure rollers (28') is characterized as having a plurality of protrusions 29 formed on its surface, as shown in FIG. 11A, having flat outer surfaces and being arranged in rows and separated from the others like islands. As the thin abrading layer 3" and the layer of the adhesive 5 are sandwiched and pressed together between the pair of pressure rollers 27 and 28', only the portions of the thin abrading layers 3" corresponding to the areas of these protrusions 29 are caused to become adhered to the polyester sheet 6.

Next, while the thin abrading layer 3" and the layer of the adhesive 5 are sandwiched between the polyester sheet 6 and the polypropylene sheet 4, they are passed inside a dryer 24 such that the adhesive 5 is hardened. Thereafter, the polypropylene sheet 4 is peeled off by means of a small roller 26 from the thin abrading layer 3", but these portions of the thin abrading layer 3" which were pressed by the protrusions 29 on the lower pressure roller 28' are firmly attached to the polyester sheet 6. Thus, only the remaining portions of the thin abrading layer 3" are separated from the layer of the adhesive 5 on the surface of the polyester sheet 6, together with the polypropylene sheet 4.

Finally, a brush 30 is used together with an organic solvent to scrape off the binder 2 covering the alumina particles 1 contained in the thin abrading layer 3", as more clearly shown in FIG. 10B, such that a particle-exposing abrading surface 9' will result, exposing ends of the abrading particles 1 of the thin abrading layer 3".

Figure 11B:
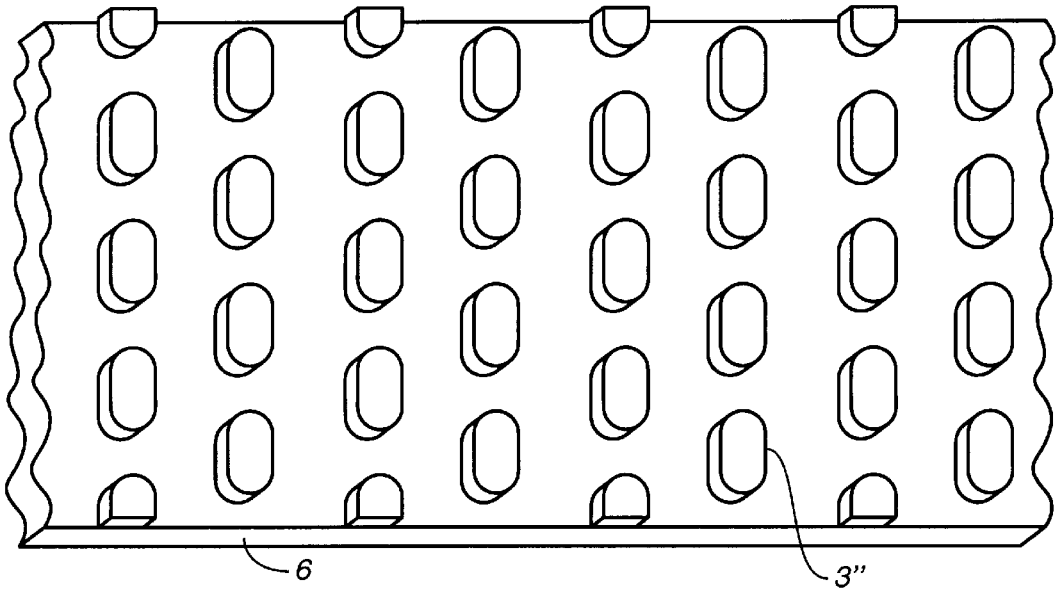
FIG. 11B is a diagonal view of a portion of an abrading sheet produced by using the roller shown in FIG. 11A.

The thin abrading layer 3" now appears like mutually isolated islands, scattered and aligned on the surface of the polyester sheet 6, as shown in FIG. 11B. The surface of the thin abrading layer 3" on the polyester sheet 6 (that is, the surfaces of these islands scattered over the surface of the polyester sheet 6) is flat, like the outer surfaces of the protrusions 29. The average density of abrading particles in this abrading surface 9' is 10 per unit area of 10 $\mu$m×10$\mu$m.

Abrasive sheets embodying this invention are thus characterized as having an abrading surface formed by peeling off a separable member and hence are advantageous in that there are no irregularly distributed protrusions and indentations on the abrading surface. Thus, they are better suited for the fine finishing of a workpiece. According to the present invention, furthermore, the thickness of the abrading layer is comparable to the average size of the abrading particles contained therein. Thus, the abrading particles are more efficiently used and the production cost of the abrasive sheets can be significantly reduced.

What is claimed is:

1. A method of producing an abrasive sheet, said method comprising the steps of:

coating a surface of a separable member with a slurry which is a mixture of abrading particles and a binder;

thereafter drying said slurry and thereby forming an abrading layer on said surface of said separable member;

coating a surface of a plastic base sheet with an adhesive and thereby forming an adhesive layer on said surface of said plastic base sheet;

thereafter superposing said surface of said plastic base sheet on a surface of said abrading layer and thereby attaching said abrading layer adhesively to said plastic base sheet; and thereafter peeling off said separable member from said abrading layer adhering to said plastic base sheet, thereby forming an abrading surface layer conforming with said surface of said separable member.

2. The method of claim 1 wherein at least said surface of said separable member contacting said abrading layer comprises a material selected from the group consisting of polytetrafluoroethylene polymers, polypropylene, glass and metals with a mirror-polished surface.

3. The method of claim 1 wherein said separable member comprises a sheet of a material selected from the group consisting of polytetrafluoroethylene polymers, polypropylene and polyethylene.

4. A method of producing an abrasive sheet, said method comprising the steps of:

coating a surface of a separable member with a slurry which is a mixture of abrading particles, which have an average diameter, and a binder, said slurry having a thickness less than about 1.5 times said average diameter of said abrading particles;

thereafter drying said slurry and thereby forming an abrading layer on said surface of said separable member;

coating a surface of a plastic base sheet with an adhesive and thereby forming an adhesive layer on said surface of said plastic base sheet;

thereafter superposing said surface of said plastic base sheet on a surface of said abrading layer;

thereafter sandwiching and pressing said plastic base sheet, said adhesive layer, said abrading layer and said separable member together between a pair of mutually opposite pressure rollers, one of said pressure rollers having a surface with protrusions, and thereby causing a portion of said abrading layer pressed by said protrusions to adhere to said plastic base sheet; and thereafter peeling off said separable member from said portion of said abrading layer adhering to said plastic base sheet, thereby forming an abrading surface layer conforming with said surface of said separable member.

5. The method of claim 4 wherein said separable member comprises a sheet of a material selected from the group consisting of polytetrafluoroethylene polymers, polypropylene and polyethylene.

6. The method of claim 4 wherein said pair of mutually opposite pressure rollers applies a pressure of 1–10 kg weight/cm.

7. The method of claim 4 wherein said slurry has viscosity between 2 cp and 50 cp.

8. The method of claim 4 wherein said slurry contains said binder and said abrading particles at a weight ratio of 1 to 6–12.

9. The method of claim 1 wherein said abrading surface formed by the peeling step is flat and smooth.

10. The method of claim 4 wherein said abrading surface formed by the peeling step is flat and smooth.

* * * * *